US006399908B1

(12) United States Patent
Mueller et al.

(10) Patent No.: US 6,399,908 B1
(45) Date of Patent: Jun. 4, 2002

(54) ELECTRIC SWITCH

(75) Inventors: Heinrich Mueller, Tuttlingen; Axel Rastemborski, Spaichingen, both of (DE)

(73) Assignee: Marquardt GmbH, Rietheim-Weilheim (DE)

( * ) Notice: Subject to any disclaimer, the term of this patent is extended or adjusted under 35 U.S.C. 154(b) by 0 days.

(21) Appl. No.: 09/402,421

(22) PCT Filed: Apr. 4, 1998

(86) PCT No.: PCT/EP98/01981

§ 371 (c)(1),
(2), (4) Date: Oct. 7, 1999

(87) PCT Pub. No.: WO98/45865

PCT Pub. Date: Oct. 15, 1998

(30) Foreign Application Priority Data

Apr. 9, 1997 (DE) ..... 197 14 611
Jun. 28, 1997 (DE) ..... 197 27 553

(51) Int. Cl.[7] ..... H01H 1/34
(52) U.S. Cl. ..... 200/249; 200/332; 29/622
(58) Field of Search ..... 200/332, 335, 200/249, 401; 29/622

(56) References Cited

U.S. PATENT DOCUMENTS

| | | | | | |
|---|---|---|---|---|---|
| 2,743,331 | A | * | 4/1956 | Lauder et al. | 200/67 |
| 2,898,428 | A | * | 4/1959 | Holden | 200/172 |
| 3,270,156 | A | * | 8/1966 | Stewart | 200/67 |
| 3,484,572 | A | * | 12/1969 | Froyd | 200/172 |
| 3,767,881 | A | * | 10/1973 | Sharples | 200/172 A |
| 3,774,000 | A | * | 11/1973 | Beer | 200/172 A |
| 3,832,508 | A | * | 8/1974 | Beck | 200/332 |
| 4,230,919 | A | * | 10/1980 | Schantz et al. | 200/67 B |
| 4,520,254 | A | | 5/1985 | Steiger et al. | 219/121 L |
| 4,673,778 | A | * | 6/1987 | Lewandowski et al. | 200/67 B |
| 4,874,912 | A | * | 10/1989 | Kakuta et al. | 200/16 D |
| 4,972,166 | A | * | 11/1990 | Mitsch et al. | 335/128 |
| 5,339,059 | A | * | 8/1994 | Kawamura et al. | 335/78 |
| 5,376,764 | A | * | 12/1994 | Retter et al. | 200/245 |
| 5,459,295 | A | * | 10/1995 | Ohta et al. | 200/461 |

FOREIGN PATENT DOCUMENTS

| | | |
|---|---|---|
| CH | 251 009 | 8/1948 |
| DE | 31 50 210 A1 | 7/1983 |
| DE | 39 13812 A1 | 1/1990 |
| DE | 89 15 158.5 | 2/1990 |
| DE | 40 25 068 A1 | 2/1992 |
| DE | 195 12 277 A1 | 10/1995 |
| DE | 296 17 793 U1 | 11/1996 |
| EP | 3-77219 | 4/1991 |
| FR | 2 638 280 | 4/1990 |
| GB | 2 072 949 A | 10/1981 |

OTHER PUBLICATIONS

Official Action for 197 27 553.2; Germany; Nov. 24, 1997.

* cited by examiner

*Primary Examiner*—P. Austin Bradley
*Assistant Examiner*—Lisa N. Klaus
(74) *Attorney, Agent, or Firm*—Morgan, Lewis & Bockius LLP

(57) ABSTRACT

The invention relates to an electric switch (1) with a contact system (9) which consists of at least one fixed contact (10, 11) and of a movable contact tongue (12). A movable actuating member (5) is operatively connected to the contact tongue (12) for changing over the contact system (9). The contact tongue (12) is arranged on a bearing (18) designed in the manner of a knife-edge bearing. The switch point of the contact system (9) is adjustable by the shift of part of the contact system (9) in the direction of movement (20, 20') of the actuating member (5), in that the bearing (18) and/or the fixed contact (10, 11) and/or the contact tongue (12) is capable of being set in the direction of movement (20, 20') of the actuating member (5). In order to adjust the switch point of the contact system (9), part of the actuating member (5) may also be capable of being set in the direction of movement (20, 20') of said actuating member (5).

19 Claims, 10 Drawing Sheets

ELECTRIC SWITCH

The invention relates to an electric switch according to the precharacterizing clause of patent claim 1, 2 or 3, and to a method for adjusting the switch point of an electric switch of this type according to the precharacterizing clause of patent claim 12 or 13.

In small-scale electric switches, such as quick-action switches, microswitches or the like because of the small dimensions, production tolerances in the contact system have a particularly pronounced effect on the switch point of the latter. It may therefore be necessary, in switches of this type to adjust the switch point at a later date.

DE-A 31 50 210 discloses a quick-action switch with a contact system consisting of fixed contacts and of movable contact tongues. One end of the quick-action springs is operatively connected to the contact tongues. The other end of the quick-action springs is mounted on a body which, in turns is arranged in a movable actuating member. By virtue of this mounting, the actuating member, when being moved, acts on the quick-action springs in order to change over the contact system. The body is longitudinally displaceable in the actuating member by means of a screw, so that the bearing for the quick-action springs can be set in the direction of movement of the actuating member. As a result of this setting, the quick-action switch point of the quick-action springs and therefore, in turn, the changeover point of the contact tongues can be adjusted.

In this switch, therefore, although the changeover point can be adjusted at a later date, the design of the adjusting arrangement is complicated, since a multiplicity of additional parts are necessary for this purpose. The adjusting arrangement therefore incurs increased costs for the switch and the susceptibility of the adjusting arrangement to faults also increases. The actual adjusting operation is complicated and has to be carried out manually. Adjustment is consequently time-consuming and also cost-intensive. It is not possible for the adjusting operation to be automated, so that, at all events, this switch does not seem to be suitable for mass production.

The object on which the invention is based is to design an electric switch in such a way that the switch point of tile contact system can be adjusted at a later date in a simple way. In particular, the adjusting operation is also to be suitable for largely automated mass production of the switch.

In a generic electric switch, this object is achieved by means of the characterizing features of claim 1, 2 or 3. A method for adjusting the switch point is specified in more detail by the features of patent claim 12 or 13.

In the solution according to the invention, the bearing for the contact tongue of the contact system and/or the contact tongue itself and/or the fixed contact of the contact system and/or part of the actuating member is capable of being set in the direction of movement of the actuating member. This setting of the bearing and/or of the fixed contact and/or of the contact tongue and/or of part of the actuating member is preferably carried out by means of mechanical or thermal deformation, in particular permanent deformation, which is introduced during or after the fitting of the contact system to a carrier receiving the bearing or the fixed contact, or the contact tongue or part of the actuating member. This deformation may be plastic deformation. The subclaims relate to further refinements of the invention.

The connection, designed as a carrier, between an electric terminal of the switch and the bearing may possess a first portion which runs approximately transversely to the direction of movement of the actuating member. This portion may have adjoining it a second portion running approximately in the direction of movement of the actuating member. The first and second portions then form, on the carrier for the bearing, a protuberance shaped essentially perpendicularly to the direction of movement of the actuating member. This protuberance is approximately U-shaped, half-S-shaped, in the form of a question mark or else S-shaped.

The setting of the bearing for adjusting the changeover point may be carried out by means of a tool which acts on the carrier for the bearing and in the direction of the bearing. It is appropriate for the tool to have a wedge-shaped design. In order to set the bearing, this tool is then displaced approximately transversely to the direction of movement of the actuating member, with the result that the tool acts on the carrier first portion running transversely to the direction of movement of the actuating member, the consequence of which is that the protuberance on the carrier is widened. If appropriate, a further tool with a supporting surface may also be used, in which case, during setting, the supporting surface bears supportingly on the second portion running in the direction of movement of the actuating member.

In a further design, the tool may also be an embossing tool. By means of the embossing tool, at least one embossing can be introduced into the carrier for the bearing. This deformation introduced into the carrier by the embossing causes the bearing to be displaced in the direction of movement of the actuating member. Furthermore, for adjustment, an embossing or other mechanical deformation may also be introduced into the contact carrier for the fixed contact of the contact system or into a switching lever which, as part of the actuating member, acts on a tappet leading into the housing of the switch.

In a preferred version, the carrier receiving the bearing, the contact carrier receiving the fixed contact, the switching lever or another functionally relevant structural part of the switch consists at least partially of a thermally deformable material. For adjustment, thermal action of this kind takes place, so that the carrier, the contact carrier, the switching lever or the other structural part experiences deformation, the deformation having a component in the direction of movement of the actuating member. Furthermore, it is preferred to carry out the thermal action by means of the individual pulses of laser beams, with the result that the size of the deformation can be accurately controlled. If action is to take place on the carrier, located inside the housing, for the bearing or the contact carrier for the fixed contact or the contact tongue, it is expedient for a window transparent to the laser beams to be provided on the housing of the switch.

So that the adjusting operation can also be carried out in a way which is capable of being automated, the following procedure is appropriate. Taking into account the maximum tolerances which occur, the contact system is dimensioned in such a way that, after fitting, the contact system initially does not yet reach the switch point during the associated actuating travel of the actuating member. During subsequent adjustment, the actuating member is then shifted by the amount of the associated actuating travel and the action of the adjusting tool then takes place on the carrier for the bearing, the contact carrier, the contact tongue or the switching lever, in that the wedge-shaped tool is advanced in a direction transverse to the direction of movement of the actuating member, the embossing tool introduces corresponding embossings or thermal heating by laser beams or the like. As a result of these actions, deformation takes place which causes setting in the direction of movement of the actuating member. The action then takes place until the contact tongue kicks over. Kickover can be detected in a simple way by the opening, closing or changeover of the contact system, if the switch is connected with its electric terminals to an electric circuit during adjustment. The adjusting operation by means of the adjusting tool can likewise be terminated when the bearing, the fixed contact, the switching lever or another functionally relevant structural part of the switch has reached a predetermined position. An optical monitoring device, for example a light barrier, can detect when this position is reached.

In a preferred embodiment, the switch possesses electric terminals which are designed in the manner of contact surfaces. These contact surfaces run, essentially plane, approximately parallel to the underside of the switch housing. The switch can consequently be fitted to a printed circuit board by the SMD technique (SMD=Surface Mounted Device).

The advantages achieved by means of the invention are, in particular, that it becomes possible to adjust the switch point and the differential travel for the switch as well as the contact position or the contact clearance for the contact system by means of a simple and cost-effective arrangement which is not susceptible to faults. Adjustment takes place in a simple way, avoids adjustment problems and is capable of being automated. A switch of this kind is therefore also suitable particularly for mass production. The invention can be implemented particularly advantageously in small-scale switches, such as quick-action switches or microswitches, as well as in SMD switches. These can be produced with much narrower tolerances than hitherto as regards to the switch point of the contact system or the differential travel for the actuating member, without the dimensional tolerances for the individual parts of the contact system having to be restricted excessively. On the contrary, the influence of the tolerances of the individual parts is largely eliminated As a result, the follow-up travel of the switch can, in turn, be increased, this being desirable in many instances of use of the switch. Even switches not conforming to the specifications can also be adjusted at a later date, so that the rejection rate in the production of the switch is reduced.

Exemplary embodiments of the invention are illustrated in the drawings and are described in more detail below.

Figure 1:
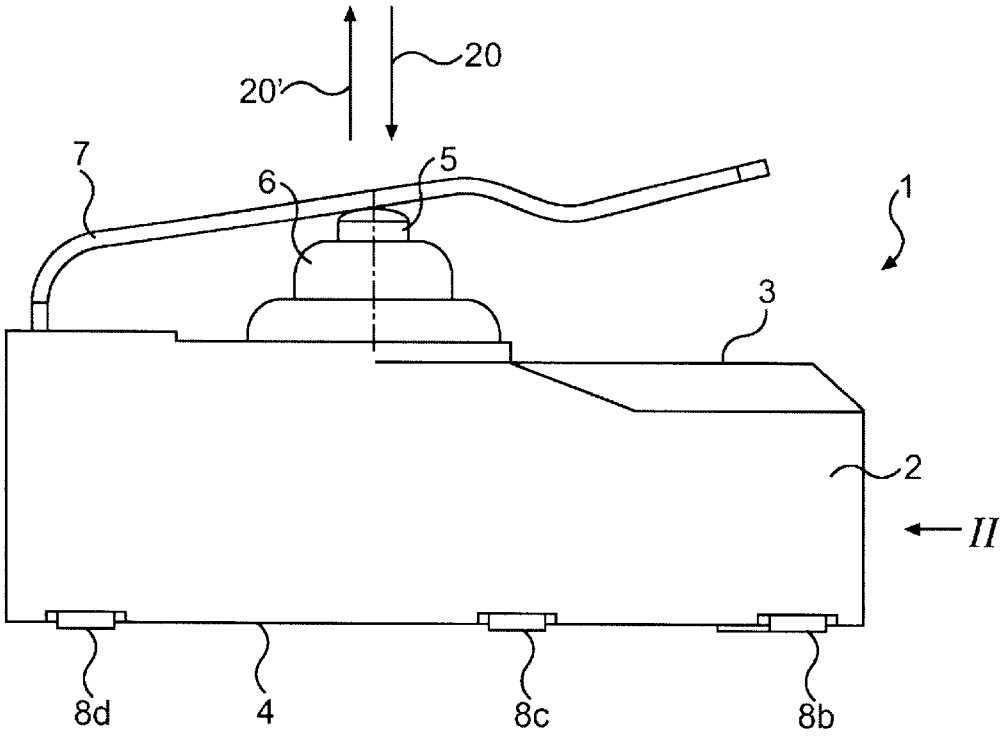
FIG. 1 shows a side view of an electric switch.
Figure 3:
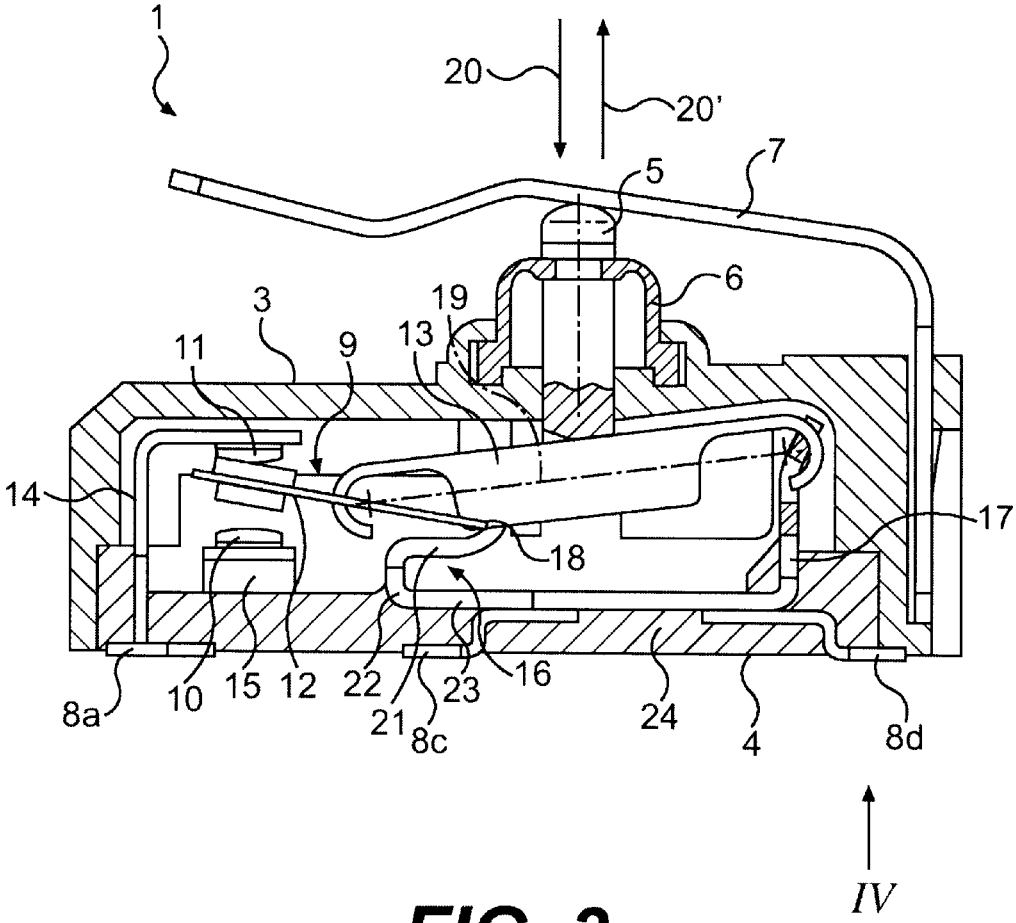
FIG. 3 shows a section along the line 3—3 in FIG. 2.
Figure 5:
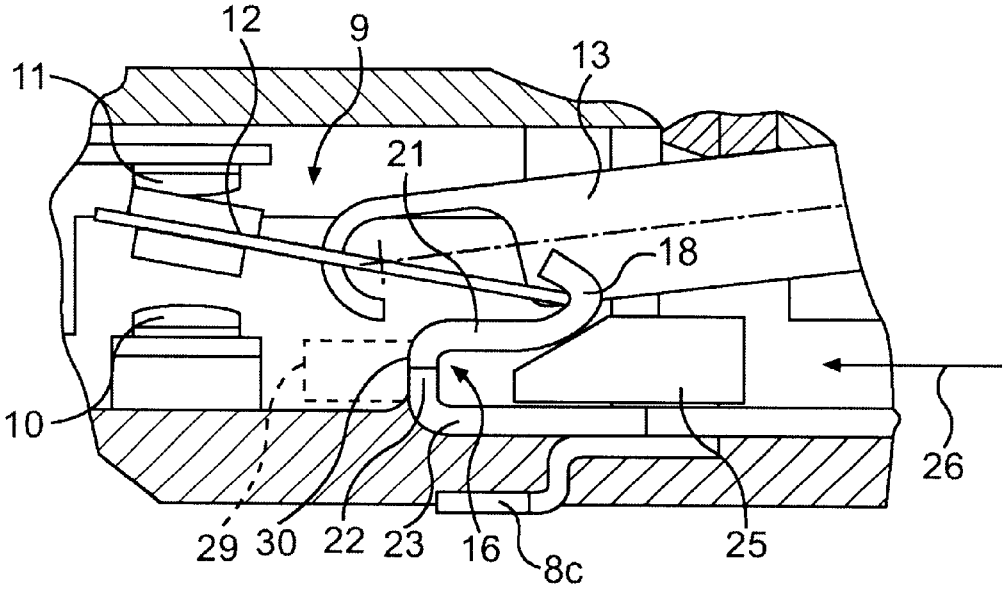
Figure 6:
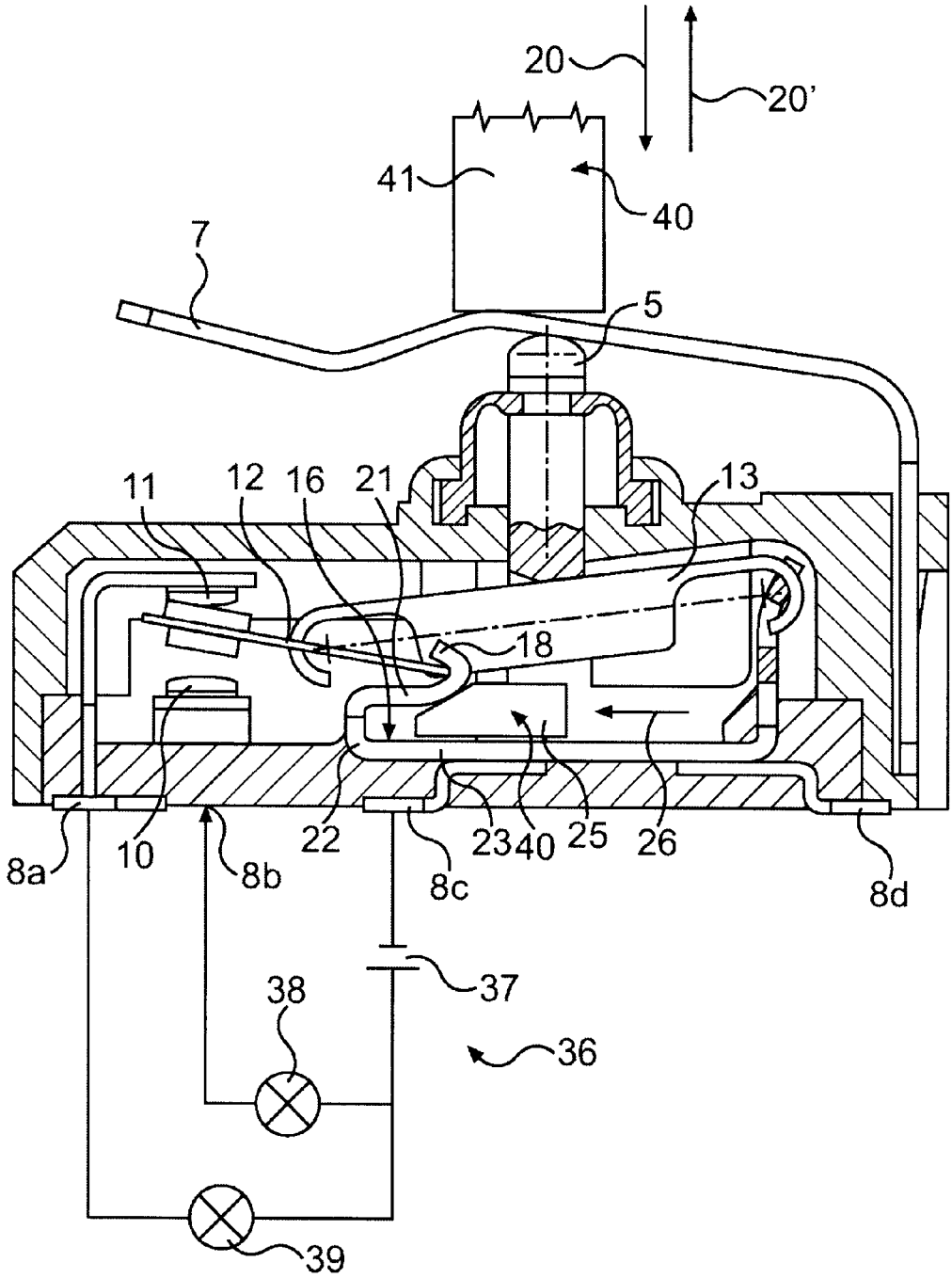
Figure 7:
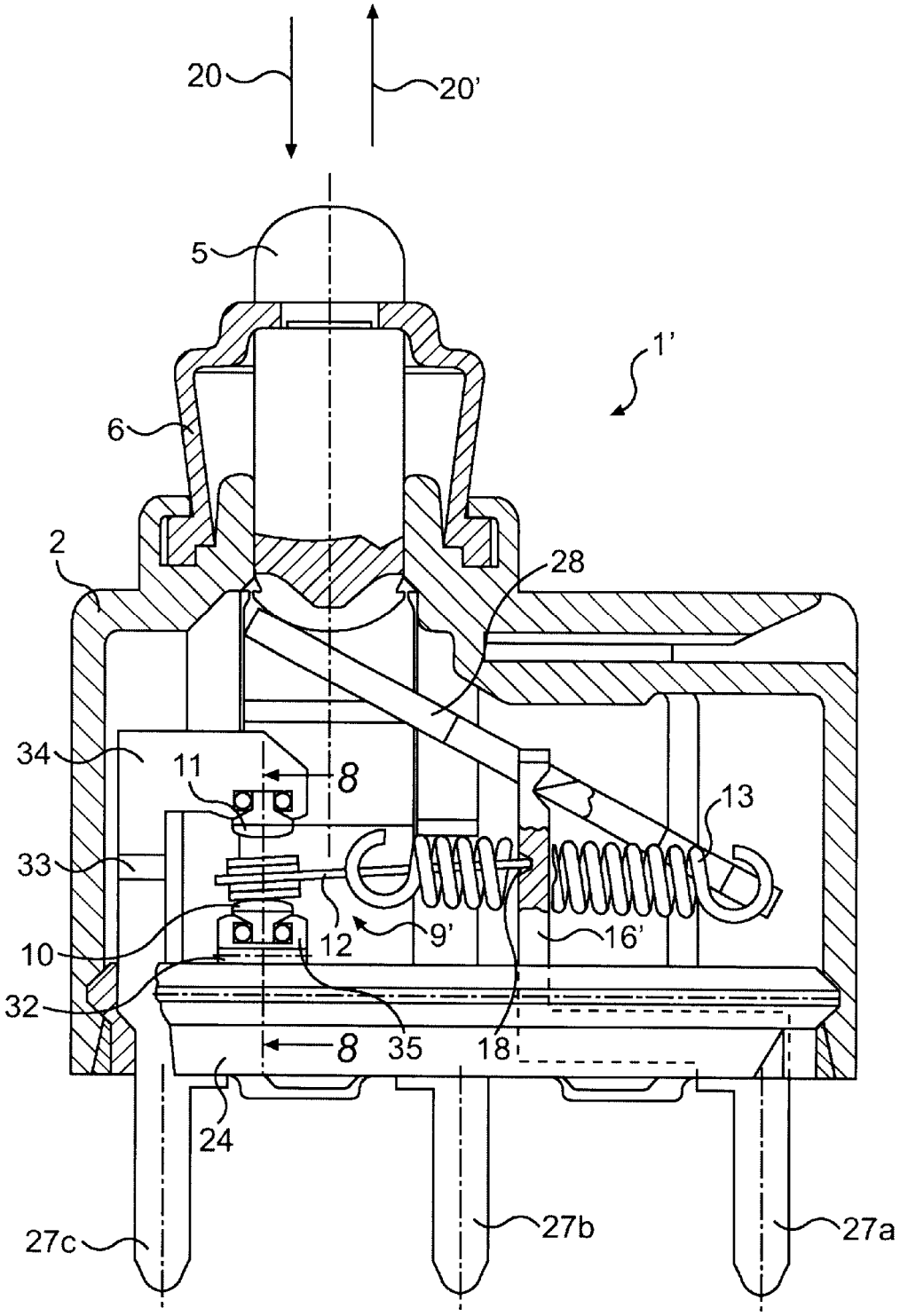
Figure 8:
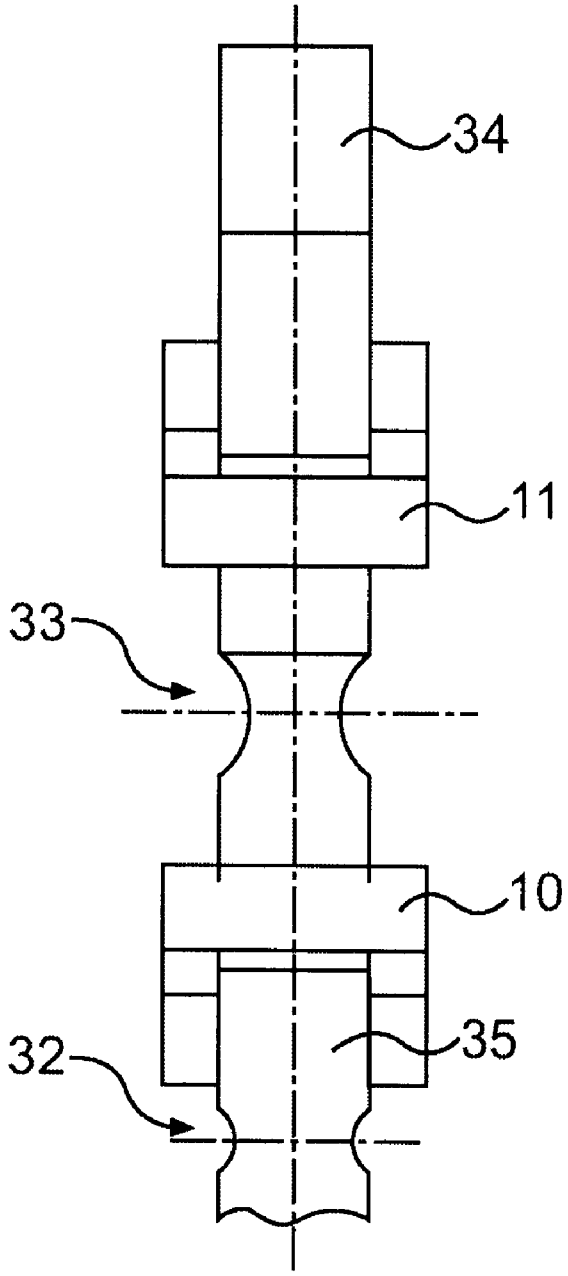
Figure 9:
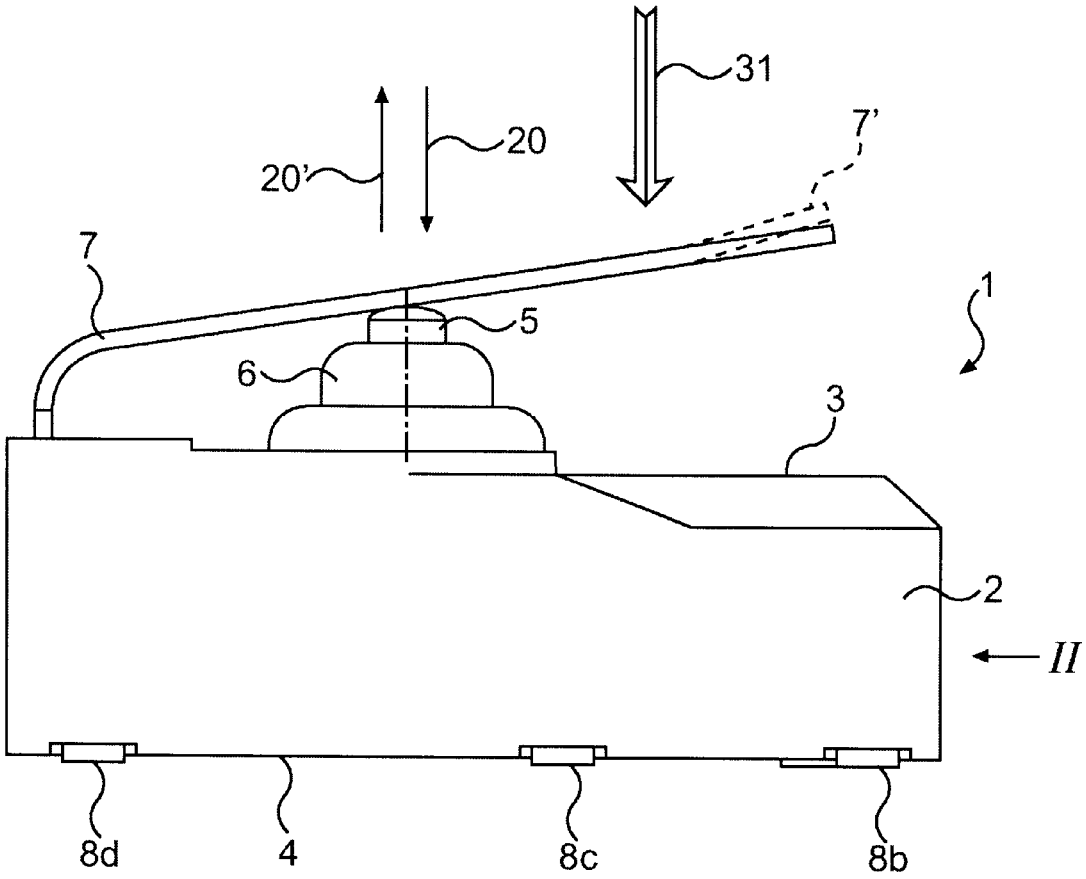
Figure 10:
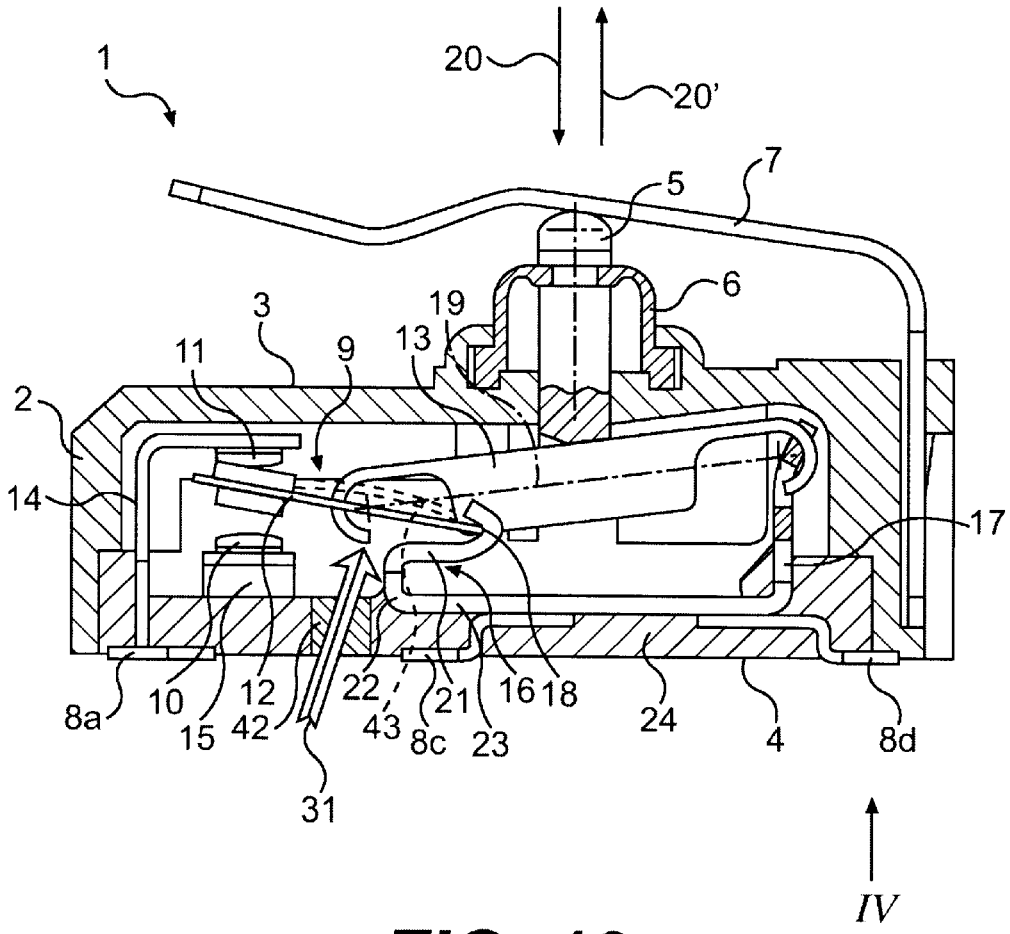

FIG. 5 shows an enlarged detail from FIG. 3 in the region of the bearing, FIG. 6 shows a switch, as in FIG. 3, during the adjustment of the switch point, the switch being connected to an indicating and adjusting device shown diagrammatically, FIG. 7 shows a section, as in FIG. 3, according to a further embodiment, FIG. 8 shows a section along the line 8—8 in FIG. 7, FIG. 9 shows an electric switch, as in FIG. 1, according to a further embodiment, and FIG. 10 shows a section, as in FIG. 3, in yet another embodiment.

Figure 2:
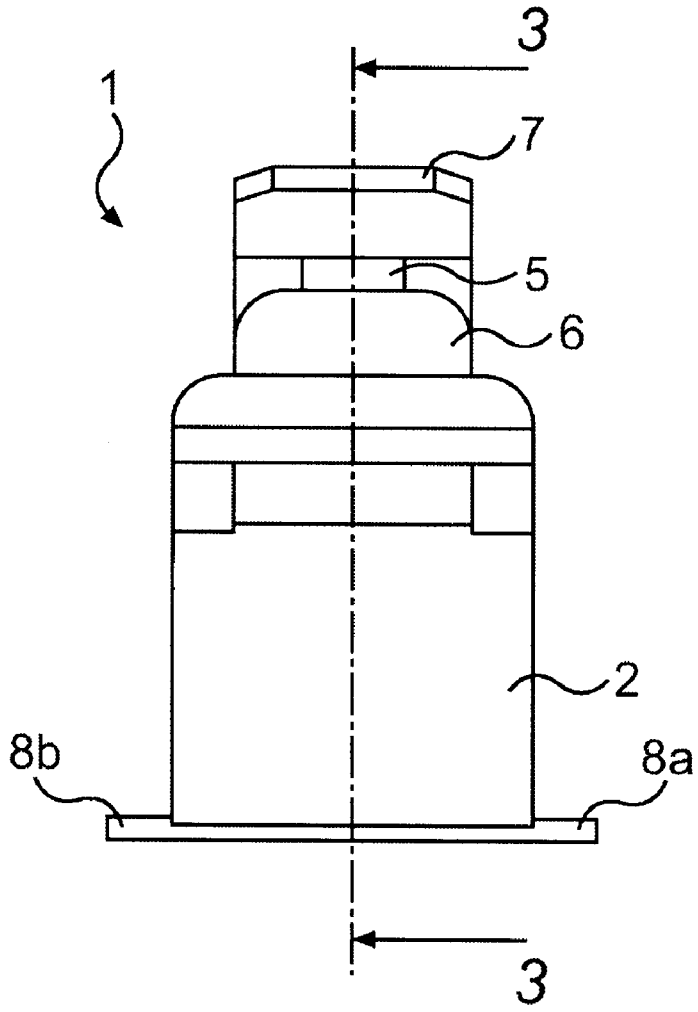
FIG. 2 shows the electric switch from the direction II in FIG. 1.

An electric switch 1 designed in the manner of a microswitch and having a housing 2 can be seen in FIGS. 1 and 2. On the top side 3 of the housing 2, an actuating member 5 designed as a tappet projects and is capable of being moved essentially in a direction 20, 20' running perpendicularly to the top side 3. In order to move the actuating member 5, a switching lever 7 acts, in turn, on the latter, so that the actual actuation of the switch 1 takes place via the switching lever 7. The actuating member 5 is provided with an elastic sealing cowl 6 in order to protect the interior of the housing 2.

As may also be gathered from FIG. 3, a contact system 9 is arranged in the interior of the housing 2, where the contact system may be designed as a break, make or changeover. The contact system 9 consists of at least one fixed contact 10, of a movable contact tongue 12 as a switching contact and of a spring 13 operatively connected to the contact tongue 12. In the present case, the contact system 9 also contains a further fixed contact 11., so that the contact system 9 acts as a changeover. The fixed contacts 10, 11 are arranged on carrier parts 14, 15. The contact tongue 12 is arranged so as to be movable in its longitudinal direction approximately transversely to the direction of movement 20, 20' on a bearing 18 which is designed in the manner of a knife-edge bearing. The bearing 18 is located on a part which is designed in the manner of a carrier and which thus constitutes a carrier part 16. The carrier part 16 runs, in the region of the bearing 18, approximately parallel to the direction of movements 20, 20'. The spring 13, designed as a tension spring, is suspended at one end in the contact tongue 12 and at the other end in a further carrier part 17. The carrier parts 14, 15, 16, and 17 are fastened to the base 24 of the housing 2.

Figure 4:
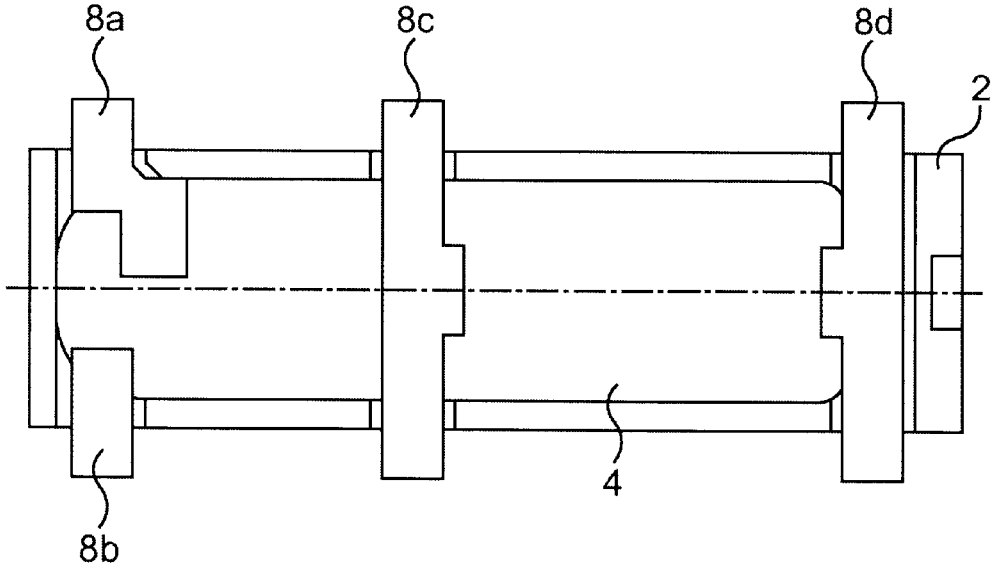
FIG. 4 shows the electric switch from the direction IV in FIG. 3.

As may be gathered, in particular, from FIG. 4, electric terminals 8*a*, 8*b*, 8*c*, 8*d* project on the underside 4 of the housing 2, said underside being assigned to the base 24. The terminals 8*a*, 8*b*, 8*c* and 8*d* are designed in the manner of contact surfaces. The contact surfaces, in turn, run essentially parallel to the underside 4 of the housing 2 and are flat or plane on the base 24 of the housing 2. As a result, the switch 1 can be fitted to a printed circuit board by the SMD technique (SMD=Surface Mounted Device) and can therefore be further processed by means of an assembly machine.

As is apparent from FIG. 3, the contact system 9 is electrically connected to the terminals 8*a*, 8*b*, 8*c* and 8*d* via the carrier parts 14, 15, 16 and 17, respectively. Here, the terminals 8*a* and 8*b* are assigned the carrier parts 14 and 15 for the fixed contacts 11 and 10, the terminal 8*c* is assigned the carrier part 16 for the bearing 18 and the terminal 8*d* is assigned the carrier part 17. When the actuating member 5 is in the position of rest, shown in FIG. 3, the contact tongue 12 bears on the fixed contact 11. Consequently, in this first switching position of the contact system 9, an electric connection is made between the terminals 8*a* and 8*c*. In order to change over the contact system 9, the actuating member 5 is moved in the direction 20, the actuating member 5 acting on the spring 13. The switch point of the contact system 9, at which the contact tongue 12 kicks over, is reached when the effective line 19 of the spring 13 coincides approximately with the longitudinal direction of the contact tongue 12. The switch point is thus assigned a specific actuating travel in the direction 20 which the actuating member 5 executes by moving out of the position of rest until the switch point is reached. After the switch point has been exceeded, the contact tongue 12 bears on the fixed contact 10, and, in this second switching position of the contact system 9, an electric connection is made between the terminals 8*b* and 8*c*. When the contact system 9 is changed over again, the actuating member 5 is moved back into the position of rest the actuating member 5 likewise being assigned an actuating travel in the direction 20' until the switch point is reached. The differential travel is the difference between the size of the actuating travel in the direction 20 and of that in the direction 20'.

The desired size of the actuating travel and consequently the tolerances for the switch point and the differential travel are determined, as a rule, by the use of the switch 1. On account of production tolerances which occur, in particular, during the mass production of switches of this type of small overall size, however, the actuating travel actually obtained often fluctuates considerably from switch to switch. In order to adapt the actuating travel to the size determined, in a first version of the switch 1 the switch point, which again is assigned to the actuating travel, is designed to be capable of being adjusted as a result of a shift of part of the contact system 9 in the direction of movements 20 and 20' of the actuating member 5. For this adjustment of the switch point, according to the invention the bearing 18 is designed to be capable of being set in the direction of movement 20 and 20' of the actuating member 5. Of course, in order to adjust the switch point, a shift of the point of suspension of the spring 13 on the carrier part 17 in the direction of movement 20 and 20' may be carried out alternatively or else additionally. In other alternatives, the carrier part 14 and 15 serving as a contact carrier for the fixed contact 10 and 11, the switching lever 7 or another structural part functionally relevant to the contact system and located on the switch 1 are designed to be capable of being set in the direction of movement 20 and 20'. Various embodiments of a switch capable of being set in this way will be described in more detail below.

In the embodiment shown in more detail in FIGS. 3 and 5, the carrier part 16 for the bearing 18 possesses a first portion 21 which runs approximately transversely to the direction of movement 20 and 20' of the actuating member 5. It is appropriate, in particular, to arrange the first portion 21 approximately perpendicularly to the direction of movement 20 and 20'. The first portion 21 has adjoining it a second portion 22 which runs approximately in the direction of movement 20 and 20' of the actuating member 5. The second portion 22 has adjoining it furthermore, a third portion 23 which runs approximately parallel to the first portion 21 and is fastened in the base 24 of the housing 2. The third portion 23 contacts the terminal 8*c*. By virtue of this refinement, the first and second portions 21 and 22 form a kind of protuberance on the carrier part 16 for the bearing 18, said protuberance being shaped approximately perpendicularly to the direction of movement 20 and 20' of the actuating member 5. For example, this protuberance could also be designated as being approximately half-S-shaped, in the form of a question mark or else U-shaped, the "U" being arranged horizontally.

The setting of the bearing 18 is carried out during the fitting of the contact system 9, or after its fitting, before the housing 2 is closed. Of course, an orifice, not shown any further, may also be provided in the housing 2 in order to allow adjustment at a later date. As may be seen diagrammatically in FIG. 5, for the actual setting operation a tool 25 acts on part of the bearing 18 in such a way that a component of the effective direction of the tool 25 is aligned in the direction of movement 20 and 20' of the actuating member 5 and therefore with the bearing 18. During action by the tool 25, permanent deformation of the carrier part 16 is carried out, so that the setting of the bearing 18 can no longer change by itself at a later date. The deformation expediently consists of a plastic deformation of the carrier part 16.

The tool 25 may be designed to be approximately wedge-shaped on the side facing the bearing 18. The tool 25 then acts with this wedge-shaped side on the first portion 21 of the carrier part 16, said first portion running approximately transversely to the direction of movement 20 and 20' of the actuating member 5. For this purpose, the tool 25 is displaceable approximately transversely to the direction of movement 20 and 20' of the actuating member 5, that is to say in the direction of the arrow 26, during the setting operation. During this displacement, the wedge-shaped side of the tool 25 then comes into contact with the portion 21 and, with the advance continuing, presses the latter ever further upward in the direction 26, so that widening of the protuberance occurs and the bearing 18 is shifted in the direction of movement 20' of the actuating member 5. The advance of the tool 25 in the direction 26 and consequently the setting operation are terminated as soon as the bearing 18 has assumed the position which is correct for the desired actuating travel of the actuating member 5. In order to ensure that widening occurs only in the direction of movement 20' and undesirable bending of the second portion 22 is prevented, the second portion 22 may be supported by a tool 29 with a supporting surface 30 during the setting operation, as indicated by broken lines in FIG. 5. If necessary, of course, a tool may also act on the first portion 21 in such a way that the protuberance is compressed, with the result that the bearing 18 is shifted in the direction of movement 20 of the actuating member 5.

In a method for adjusting the switch point of such an electric switch 1 in order to achieve the desired associated actuating travel, the kickover of the contact system 9 is utilized for terminating the adjusting operation. Taking into account the tolerances occurring during the production of the individual parts, the contact system 9 is dimensioned in such a way that, after fitting, the switch point of the contact system 9 is initially not yet reached in the case of the actuating travel determined for the actuating member 5. After fitting, the actuating member 5 is shifted by the amount of the actuating travel determined, and the setting of the bearing 18 is carried out, as described above, until the contact tongue 12 kicks over.

The kickover of the contact tongue 12 may be detected optically by means of a light barrier or the like or else, preferably, by the electric breaking, making or changeover of the contact system 9, depending on its design. For this purpose, it is merely necessary to connect the switch 1 with its terminals 8*a*, 8*b* and 8*c* and, if appropriate, 8*d* to an electric circuit. When the contact tongue 12 kicks over, the switching signal of the switch 1 then changes, and this, in turn, may be utilized as a trigger for stopping the tool 25.

An adjusting method using this principle is described in more detail with reference to FIG. 6.

After or during fitting, the switch 1 is introduced for adjustment into an adjusting device 40, indicated merely diagrammatically in FIG. 6, and the electric terminals 8*a*, 8*b* and 8*c* of the switch 1 are connected to an indicating device 36. The indicating device 36 contains a voltage source 37 which is connected to the terminal 8*c*. Furthermore, in the indicating device 36 there are light-emitting means, for example a green light-emitting diode 38 contacting the terminal 8*b* and a red light-emitting diode 39 contacting the terminal 8*a*. Since the switch 1 is in the first switching position in which the contact tongue 12 bears on the fixed contact 11, the red light-emitting diode 39 lights up.

A plunger 41 of the adjusting device 40 thereafter acts on the actuating member 5 in such a way that the latter covers exactly the determined actuating travel in the direction of the arrow 20 and is retained in this position. Due to the dimensioning of the contact system 9, however, the switch point is not yet reached, with the result that the contact system 9 remains in the first switching position and the red light-emitting diode 39 continues to light up.

The action of the adjusting tool 25 of the adjusting device 40 subsequently takes place on part of the bearing 18, specifically, as already described, due to the advance of the wedge-shaped tool 25 in the direction 26, the bearing 18 being shifted in the direction of the arrow 20'. This advance of the tool 25 is then continued until the contact tongue 12 kicks over into the second switching position, with the result that the contact tongue 12 comes to bear on the fixed contact 10. At the same time, the red light-emitting diode 39 is extinguished and the green light-emitting diode 38 lights up. As soon as the green light-emitting diode 38 lights up, the switch point of the contact system 9 is correlated with the determined actuating travel of the actuating member 5 and the adjusting operation is terminated. If appropriate, the advance of the wedge-shaped tool 25 is also to be continued somewhat beyond this switch point, in order to take into account a spring-back of the first portion 21 on the carrier part 16.

A switch 1' in a second embodiment, which can be seen in more detail in FIG. 7, possesses a somewhat modified contact system 9', parts comparable to the switch 1 being given the same reference symbols. In this switch 1', the actuating member 5 movable in the direction of movement 20 and 20' acts on a first lever arm of a two-armed inner lever 28. Suspended on the second lever arm of the inner lever 28 is one end of a spring 13 which, in turn, is suspended at its other end on a contact tongue 12. The contact tongue 12 is movably mounted in a bearing 18 which is illustrated in FIG. 7 in a part section through the spring 13. The bearing 18 is located on a carrier part 16' making an electric connection with a terminal 27*a*. The two fixed contacts 10 and 11 are arranged on contact carriers 34 and 35 which, in turn, make a connection with the electric terminals 27*c* and 27*b* of the switch which are designed as plug terminals. The movable actuating member 5 is consequently operatively connected to the contact tongue 12 via the inner lever 28 and the spring 13 for the changeover of the contact system 9'.

In this version, instead of the bearing 18 or else in addition to the bearing 18, another part of the contact system 9', specifically the fixed contacts 10 and 11, can be set in the direction of movements 20 and 20' of the actuating member 5, with the result that the contact position and the contact clearance are adjusted. A tool designed as an embossing tool may be used for setting.

By means of the embossing tool, at least one indentation or embossings 32 and 33 are is introduced into the contact carrier 35 and/or 34 for the fixed contacts 10 and 11 respectively as may be seen particularly clearly in FIG. 8. As a result of the embossings 32 and 33, the contact carriers 34 and 35 are stretched plastically and the fixed contacts 10 and 11 are thereby displaced in the direction of movements 20 and 20' of the actuating member 5. If the displacement achievable by means of embossings 32 and 33 is not sufficient, then, of course, a plurality of embossings 32 and 33 may also be introduced or the depth of penetration of the embossings 32 and 33 may be varied. However, FIGS. 7 and 8 show only one embossings 32 and 33 in the contact carriers 34 and 35 respectively. The action of the adjusting tool and consequently the embossing in the contact carrier 34 and 35 takes place until the fixed contacts 10 and 11 has reached a predetermined position, so that the contact clearance of the fixed contacts 10 and 11 has the desired size. Optical monitoring of the position assumed by the fixed contacts 10 and 11 may be adopted in order to detect when this position is reached. For optical monitoring, it is possible, for example, to use a light barrier which, when the predetermined position is reached, emits a signal which, in turn, is utilized in order to terminate the embossing.

The bearing 18 for the contact tongue 12, the carrier parts 14 and 15 or the contact carriers 34 and 35 for the fixed contacts 10 and 11, the switching lever 7 or other structural parts functionally relevant to the contact system 9 can be set mechanically in the way described. It is particularly preferable also to have an adjusting operation which takes place essentially contactlessly and which will be explained in more detail by means of the following exemplary embodiment.

As shown in FIG. 9, the setting of the actuating travel for the switch 1 is carried out by means of thermal deformation on the switching lever 7. For this purpose, the switching lever 7 consists at least partially of a material which is permanently deformable thermally. For example, the material may be copper alloys, steel or the like. Pulses of laser beams 31 act on one side of the switching lever 7 by means of a laser. The location on the switching lever 7 at which the laser beams 31 impinge is thereby heated on one side and the material of the switching lever 7 expands at this location. By being heated on one side, the switching lever 7 undergoes warping with a component in the directions 20 and 20', so that the switching lever finally permanently assumes the position designated by reference symbol 7'. By appropriate control of the power of the laser beams 31 or of the number of pulses of laser beams 31, thermal deformation of the desired size can be generated, so as to result in the corresponding setting of the actuating travel for the switch 1. Heating may, of course, also take place in another way, for example inductively or the like.

According to an exemplary embodiment shown in FIG. 10, the parts of the contact system 9 which are located inside the housing 2 of the switch 1, such as the carrier 16 receiving the bearing 18, the contact carriers 14 and 15 receiving the fixed contacts 10 and 11, the contact tongue 12 or the like, can also be set by means of thermal deformation. For this purpose, a window 42 transparent to the laser beams 31 is affixed to the housing 2. The laser beams 31 pass through this window 42 into the interior of the housing 2 virtually without any loss. In FIG. 10, the laser beams are directed onto the contact tongue 12, so that deformation 43, depicted by broken lines, is generated on the contact tongue 12. By virtue of the size of the deformation 43, it is possible, in turn, to set the switch point at which the contact tongue 12 changes over and, consequently, the switch point of the contact system 9. As is immediately apparent, the switch 1 can be fitted complete and setting can be carried out thereafter, since contactless setting can also take place inside the housing 2 via the window 42. Of course, metal coatings and other aids may also be arranged on or in the housing 2, in order to align the laser beams 31 with that structural part of the switch 1 which is to be set.

The invention is not restricted to the exemplary embodiments described and illustrated. On the contrary, it also embraces all developments within the scope of the concept of the invention which are within the ability of a person skilled in the art. If necessary, adjustment of a plurality of parts, for example of the bearing for the contact tongue and/or of the fixed contacts and/or of the switching lever and/or of other structural parts functionally relevant to the contact system, may also be carried out at the same time on a switch. Furthermore, the invention can be used advantageously not only on small-scale electric switches, but also on other switches, sensors or the like.

What is claimed is:

1. A method for adjusting a small-scale electric microswitch or quick-action switch having a contact system with at least one fixed contact arranged on a contact carrier, a movable contact tongue, and a movable actuating member operatively connected to the contact tongue for changing over the contact system, wherein said contact tongue has a knife-edge bearing arranged on a carrier, and wherein for adjustment of a switch point, part of the contact system is shifted in a direction of movement of the actuating member, in that at least one of the fixed contact and the contact tongue is set, the method comprising:

adjusting the switch point of a small-scale electric microswitch or quick-action switch by introducing at least one two-sided embossing as a permanent mechanical deformation on at least one of the carrier receiving the bearing, the contact carrier receiving the fixed contact, and the switching lever.

2. The method for adjusting the switch point according to claim 1, wherein:

the contact system is electrically connected to electric terminals, a spring is operatively connected to the contact tongue, the actuating member acts as a quick-action switching system on the spring, the carrier for the bearing possesses a connection to the electric terminal of the switch, and the contact carrier for the fixed contact possesses a connection to the electric terminal of the switch.

3. The method for adjusting the switch point according to claim 1, wherein plastic deformation is introduced as permanent mechanical deformation.

4. The method for adjusting the switch point according to claim 1, wherein setting of the switch point is carried out by means of a tool acting on the carrier for the bearing or the contact carrier for the fixed contact or a switching lever, the tool possessing an effective component in the direction of movement of the actuating member, and in that, setting is carried out during fitting or after fitting of the contact system.

5. The method for adjusting the switch point of an electric switch for achieving an associated actuating travel according to claim 4, wherein:

taking into account the tolerances which occur, the contact system is dimensioned in such a way that, after fitting and before adjusting the switch point, the contact system initially does not yet reach the switch point during the associated actuating travel of the actuating member, and wherein the step of adjusting comprises using the adjusting tool to mechanically deform the carrier for the bearing or the contact carrier for the fixed contact or a switching lever until the contact system changes over, as detected by the electric breaking, making or changeover of the contact system by means of electric terminals of the switch which are connected to an electric circuit.

6. The method for adjusting the switch point of an electric switch according to claim 5, wherein the adjusting tool is a wedge-shaped tool and the step of adjusting the switch point comprises advancing the wedge-shaped tool in a direction substantially transverse to the direction of movement of the actuating member.

7. An electric switch with an adjustable switch point comprising:

at least one fixed contact arranged on a contact carrier;

a moveable contact tongue being moveable from a first position to a second position;

a moveable actuating member with a switching lever, said actuating member operatively connected to the contact tongue;

a carrier with a curved protuberance;

a housing of the switch with a transparent window;

a knife-edge bearing for receiving the contact tongue, said knife-edge bearing arranged on the carrier, wherein at least one of the bearing, the contact tongue, the fixed contact and the switching lever are shifted in a direction of movement of the actuating member and set by thermal deformation for adjusting the switch point.

8. A method for adjusting a small-scale electric microswitch or quick-action switch having a contact system with at least one fixed contact arranged on a contact carrier, a movable contact tongue, and a movable actuating member operatively connected to the contact tongue for changing over the contact system, wherein said contact tongue has a bearing arranged on a carrier, said bearing being designed in the manner of a knife-edge bearing, and wherein for adjustment of a switch point, part of the contact system is shifted in a direction of movement of the actuating member, in that at least one of the fixed contact and the contact tongue is set, wherein a carrier part makes the electric connection between an electric terminal and the bearing and includes a first portion which runs transverse to the direction of movement of the actuating member and a second adjoining portion running in the direction of movement of the actuating member, the first and second portions forming, on the carrier for the bearing, a protuberance shaped substantially perpendicular to the direction of movement of the actuating member, and the protuberance is designed to be U-shaped, half-S-shaped, in the form of a question mark, or S-shaped, the method comprising:

adjusting the switch point of a small-scale electric microswitch or quick-action switch by introducing a permanent mechanical deformation on the carrier receiving the bearing.

9. The method for adjusting the switch point according to claim 8 wherein:

a wedge-shaped tool acts on the first portion of the carrier part such that a widening of the protuberance takes place, the tool is displaced substantially transverse to the direction of movement of the actuating member for setting of an actuating travel for the electric switch, and during setting, a further tool bears supportingly on a supporting surface on the second portion which runs substantially in the direction of movement of the actuating member.

10. The method for adjusting the switch point according to claim 1, wherein the embossing is introduced by means of a tool designed as an embossing tool in order to displace the bearing , or the fixed contact, or a switching lever in the direction of movement of the actuating member.

11. A method for adjusting a small-scale electric microswitch or quick-action switch having a contact system with at least one fixed contact arranged on a contact carrier, a movable contact tongue, and a movable actuating member operatively connected to the contact tongue for changing over the contact system, wherein said contact tongue has a knife-edge bearing arranged on a carrier, and wherein for adjustment of a switch point, part of the contact system is shifted in a direction of movement of the actuating member, in that at least one of the fixed contact and the contact tongue is set, and wherein the carrier, the contact carrier, the contact tongue, or a switching lever comprise a thermally permanently deformable material, the material being copper alloys or steel, the method comprising:

adjusting the switch point of a small-scale electric microswitch or quick-action switch by thermally deforming at least one of the carrier, the contact carrier, the contact tongue, or the switching lever using a laser, wherein a housing of the microswitch or quick-action switch includes a window transparent to laser beams of the laser and the thermal deformation is performed after the fitting of the contact system.

12. The method for adjusting the switch point of an electric microswitch or quick-action switch with a housing and electric terminals located on one side of the housing and electrically connected to the contact system according to claim 1, wherein:

the electric terminals are designed in the manner of contact surfaces, and the contact surfaces run essentially parallel to the side of the housing, so that the switch can be fitted to a printed circuit board by a Surface Mounted Device technique.

13. The method for adjusting the switch point of an electric switch according to claim 4, wherein the step of adjusting the switch point comprises using adjusting tool to mechanically deform the carrier for the bearing or the contact carrier for the fixed contact or a switching lever until the bearing or the fixed contact or the switching lever has reached a predetermined position, said predetermined position being detected by optical monitoring the position assumed by the bearing, fixed contact, or switching lever.

14. The method for adjusting the switch point according to claim 1, wherein:

the contact carrier has a broad and a narrow side with the at least one two-sided embossing performed at both ends, front and rear, on the broad side of the contact carrier.

15. The method for adjusting the switch point according to claim 14, wherein:

an embossed area is worked into the contact carrier in a way that the contact carrier is moved in the same direction as the actuating member.

16. An electric switch with an adjustable switch point comprising:

at least one fixed contact arranged on a contact carrier;

a moveable contact tongue being moveable from a first position to a second position;

a moveable actuating member with a switching lever, said actuating member operatively connected to the contact tongue;

a carrier with a first portion which extends substantially transverse to a direction of movement of the actuating member and a second, adjoining portion which extends substantially in the direction of movement of the actuating member, said first and second portions forming a curved protuberance; and a knife-edge bearing for receiving the contact tongue, said knife-edge bearing arranged on the carrier, wherein at least one of the bearing, the contact tongue, the fixed contact and the switching lever are shifted in the direction of movement of the actuating member and set by plastic deformation for adjusting the switch point.

17. A method for adjusting a switch point of an electric switch including at least one fixed contact arranged on a contact carrier, a moveable contact tongue being moveable from a first position to a second position, a moveable actuating member with a switching lever, said actuating member operatively connected to the contact tongue, a carrier with a first portion which runs substantially transverse to a direction of movement of the actuating member and a second, adjoining portion running substantially in the direction of movement of the actuating member, said first and second portions forming a curved protuberance and a knife-edge bearing for receiving the contact tongue, said knife-edge bearing arranged on the carrier, said method comprising steps of:

inserting a wedge-shaped tool into the protuberance;

placing a further tool with a supporting surface bearing on the second portion of the carrier; and displacing the wedge-shaped tool transversely in a direction of movement of the actuating member, thereby widening the protuberance and setting the bearing.

18. A method for adjusting a switch point of an electric switch including at least one fixed contact arranged on a contact carrier, a moveable contact tongue being movable from a first position to a second position, a moveable actuating member with a switching lever, said actuating member operatively connected to the contact tongue, a carrier with a first portion which runs substantially transverse to a direction of movement of the actuating member and a second, adjoining portion running substantially in the direction of movement of the actuating member, said first and second portions forming a curved protuberance and a knife-edge bearing for receiving the contact tongue, said knife-edge bearing arranged on the carrier, said method comprising steps of:

embossing one or more times with an adjusting tool at least one of the carrier for the bearing, the contact carrier for the fixed contact and the switching lever causing a mechanical deformation until at least one of the bearing, the fixed contact and the switch lever has reached a predetermined position; and embossing causing the displacing of the bearing, the fixed contact and the switching lever in the direction of movement of the actuating member.

19. A method for adjusting a switch point of an electric switch with a contact system including at least one fixed contact arranged on a contact carrier, a movable contact tongue being movable from a first position to a second position, a movable actuating member with a switching lever, said actuating member operatively connected to the contact tongue, a carrier with a curved protuberance, a housing of the switch with a transparent window, a knife-edge bearing for receiving the contact tongue, said knife-edge bearing arranged on the carrier, said method comprising steps of:

fitting of the contact system into the housing; and arranging a laser to direct laser beams into the transparent window of the housing, the laser beams acting on at least one of the carrier, the contact carrier, and the contact tongue causing permanent thermal deformation, the deformation setting at least one of the bearing, the fixed contact and the contact tongue.

* * * * *